US008096488B2

(12) United States Patent
Mueller

(10) Patent No.: US 8,096,488 B2
(45) Date of Patent: Jan. 17, 2012

(54) SHOWERHEAD AND VALVE ASSEMBLY FOR RECEIVING A RINSING SYSTEM

(75) Inventor: John Mueller, Wauwatosa, WI (US)

(73) Assignee: Idea Factory, Inc., Menomonee Falls, WI (US)

( * ) Notice: Subject to any disclaimer, the term of this patent is extended or adjusted under 35 U.S.C. 154(b) by 83 days.

(21) Appl. No.: 10/598,628

(22) PCT Filed: Mar. 8, 2004

(86) PCT No.: PCT/US2004/006966

§ 371 (c)(1),
(2), (4) Date: Sep. 6, 2006

(87) PCT Pub. No.: WO2005/097346

PCT Pub. Date: Oct. 20, 2005

(65) Prior Publication Data

US 2007/0200009 A1 Aug. 30, 2007

(51) Int. Cl.
*B05B 15/00* (2006.01)

(52) U.S. Cl. ..... 239/289; 239/442; 239/443; 239/447; 239/583

(58) Field of Classification Search ..... 239/289, 239/437–443, 444–449, 541, 552, 583
See application file for complete search history.

(56) References Cited

U.S. PATENT DOCUMENTS 3,341,132 A 9/1967 Parkison
5,560,548 A 10/1996 Mueller
5,624,073 A * 4/1997 Mueller et al. ..... 239/442

* cited by examiner

*Primary Examiner* — Christopher Kim
(74) *Attorney, Agent, or Firm* — Joseph S. Heino; Patrick M. Bergin

(57) ABSTRACT

An improved showerhead provides a fluid diverter valve that allows quick connection and disconnection of a hand held sprayer used for cleaning shower stalls and bathrooms. The diverter valve includes a valve housing having a water inlet, a first water outlet and a second water outlet. A valve runner moves between a first position wherein the valve runner seats to permit fluid communication between the inlet and the first outlet and a second position wherein the valve runner seats to permit fluid communication between the inlet and the second outlet. The valve runner is moved from the first position to the second position substantially by gravity.

9 Claims, 5 Drawing Sheets

SHOWERHEAD AND VALVE ASSEMBLY FOR RECEIVING A RINSING SYSTEM

FIELD OF THE INVENTION

This invention relates generally to the field of water valves. It also relates generally to showerheads that are used for bathing. More particularly, it relates to an improved showerhead that allows for the quick and easy connection to and disconnection from the showerhead of a hand held sprayer that is used for cleaning shower stalls and bathrooms. It also relates to an improved valve runner and housing that allows the valve runner to move axially within the housing with minimal frictional effect.

BACKGROUND OF THE INVENTION

The use of attachments in shower plumbing systems has been well known in the art for some time. Typically these attachments are comprised of a flexible conduit that may be coupled adjacent to a shower head at one end of the conduit to allow fluid communication with a hygiene nozzle secured to the second end of the conduit. These nozzles are intended for daily use and may include hand held spray heads for rinsing off during showering or dental syringes for oral hygiene.

Attachments such as those referred to above often integrate valving systems which include coupling components and diverter valves. Because these attachments are intended to be used daily in conjunction with the act of showering and/or hygiene, they are permanently coupled adjacent to the showerhead. Additionally, for those devices which are intended to be used simultaneously with the showerhead, the diverter valve may permit flow of water to the showerhead and partial flow of water to the attachment.

Permanent attachment is necessary because these devices are intended to be used on a regular basis, i.e., daily. However, such configurations are not conducive to attachments used for cleaning shower stalls or other bathroom fixtures because attachments such as these are required on a less frequent basis, i.e., only during cleaning. When not in use, these cleaning attachments may inhibit use of the showerhead. Additionally, some of the above-described devices divert only a portion of the water flow to the attachments, such that water continues to flow out of the showerhead also. When cleaning bathroom fixtures, especially shower stalls, it would be undesirable for water to continue to flow out of the showerhead because persons who have entered the shower stall to clean the area may become wet.

Furthermore, the limited range of movement of a typical showerhead and the limited head pressure in the showerhead make it difficult to direct a stream of water to all areas of the shower stall for cleaning purposes. Even when water can be directed to a desired area, the water spray pattern from a showerhead makes it difficult to contain the spray to a limited area. For example, when cleaning shower doors or the upper portions of a shower compartment, a typical showerhead cannot be positioned to direct a rinsing spray to these areas. Thus, these areas may remain unrinsed or water may be transported to these areas using some other means, such as a container.

Therefore, it is desirable to have a diverter valve assembly and cleaning attachment which would allow the cleaning attachment to be is easily removed and stored until needed. Additionally, it is desirable to provide a diverter valve which shuts off water to the showerhead when the attachment system is connected. It is also desirable to provide a rinsing system which allows water to be selectively directed to an area to be rinsed. One such device is disclosed and claimed in U.S. Pat. No. 5,560,548 (the '548 patent) issued to Mueller, et al. In the experience of this inventor, the device of the '548 patent has one drawback which is that the spring loaded valve runner can occasionally "stick" after much use and over an extended period of time. That is, the valve runner can remain in the valve "open" position even after the rinsing system attachment is disconnected. When this occurs, there is an incomplete sealing to the second water outlet which can lead to water discharge when such is not desired or required by the user. The source of this sticking, or fouling, appears to be the use of a spring-loaded valve runner within the device. The presence of naturally occurring minerals in the water or of bactericidal chemicals that are added to municipal water supplies are the most likely suspects in this fouling.

What is needed is an improved showerhead that accomplishes the desired operation and movement of the valve runner within the showerhead, but with less parts and specifically without the extra mechanical element of the spring. The use of less parts creates a device that is easier to assembly and is very reliable in its functionality through simplicity. It is also desirable to provide such an improved showerhead wherein the proper operation and movement of the valve runner to the valve "closed" position is accomplished essentially by gravity, or by gravity and nominal water pressure within the showerhead. It is further desirable to provide such an improved showerhead wherein the valve runner moves axially within the housing with very little frictional effect and essentially "floats" within the housing.

SUMMARY OF THE INVENTION

This invention relates to an improved cleaning attachment system that can be coupled to a showerhead. In the preferred embodiment, the flexible conduit is coupled directly to a showerhead which is comprised of an outer casing attached in an inner casing to define a flow chamber therebetween. This flow chamber functions to direct water flow out of the showerhead by way of shower outlet holes. The inner casing also defines an inner cavity in which a valve runner is slidably mounted. Perforations in the proximal end of the inner cavity allow fluid communication between the cavity and the flow chamber. An attachment housing is engaged with the inner casing to constrain the valve runner to axial movement within the inner cavity. The attachment housing is fastened to the valve housing to secure the valve runner in an annular cavity while allowing fluid communication between the attachment housing and the annular cavity. Gravity alone, or gravity and nominal water pressure, urges the valve runner into a first position wherein the valve runner seats adjacent to the attachment housing. In this first position, one end of the valve runner seals the second outlet, permitting fluid communication only between the inlet valve and the first outlet such that water flow is directed through the showerhead. When the flexible conduit is coupled with the attachment housing, gravity and the water pressure is overcome and the coupling urges the valve runner to a second position within the annular cavity. In this second position, an annular fin extending outwardly from the valve runner seals the first outlet, permitting fluid communication only between the inlet and the second outlet. In this second position, fluid flow is diverted from the showerhead to the attachment until the flexible conduit is uncoupled. The foregoing and other features of the improved device of the present invention will be apparent from the detailed description that follows.

DETAILED DESCRIPTION

Figure 1:
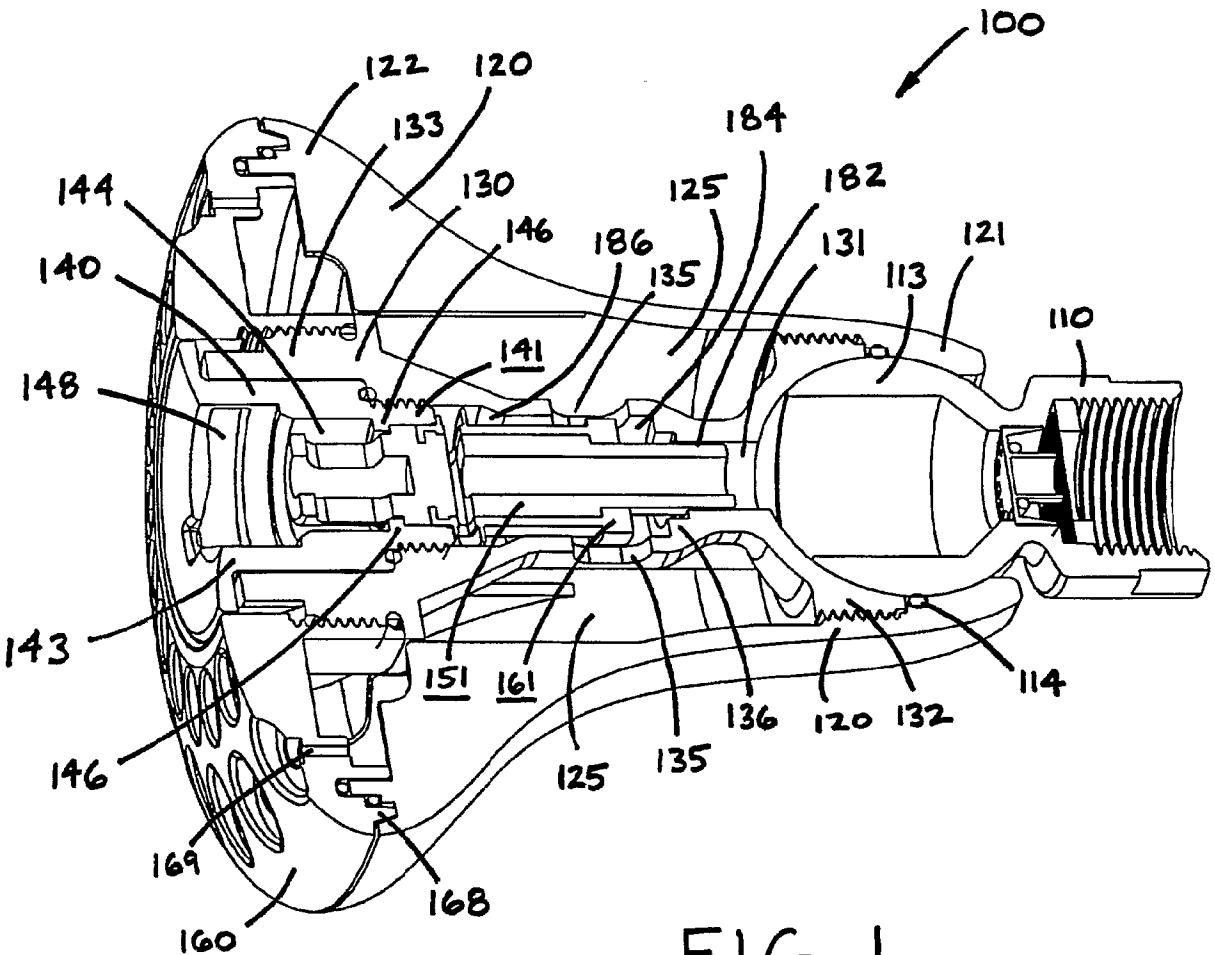
FIG. 1 is a cross sectional assembly front, side and bottom view showing an embodiment of the improved showerhead and valve assembly in accordance with the present invention.
Figure 2:
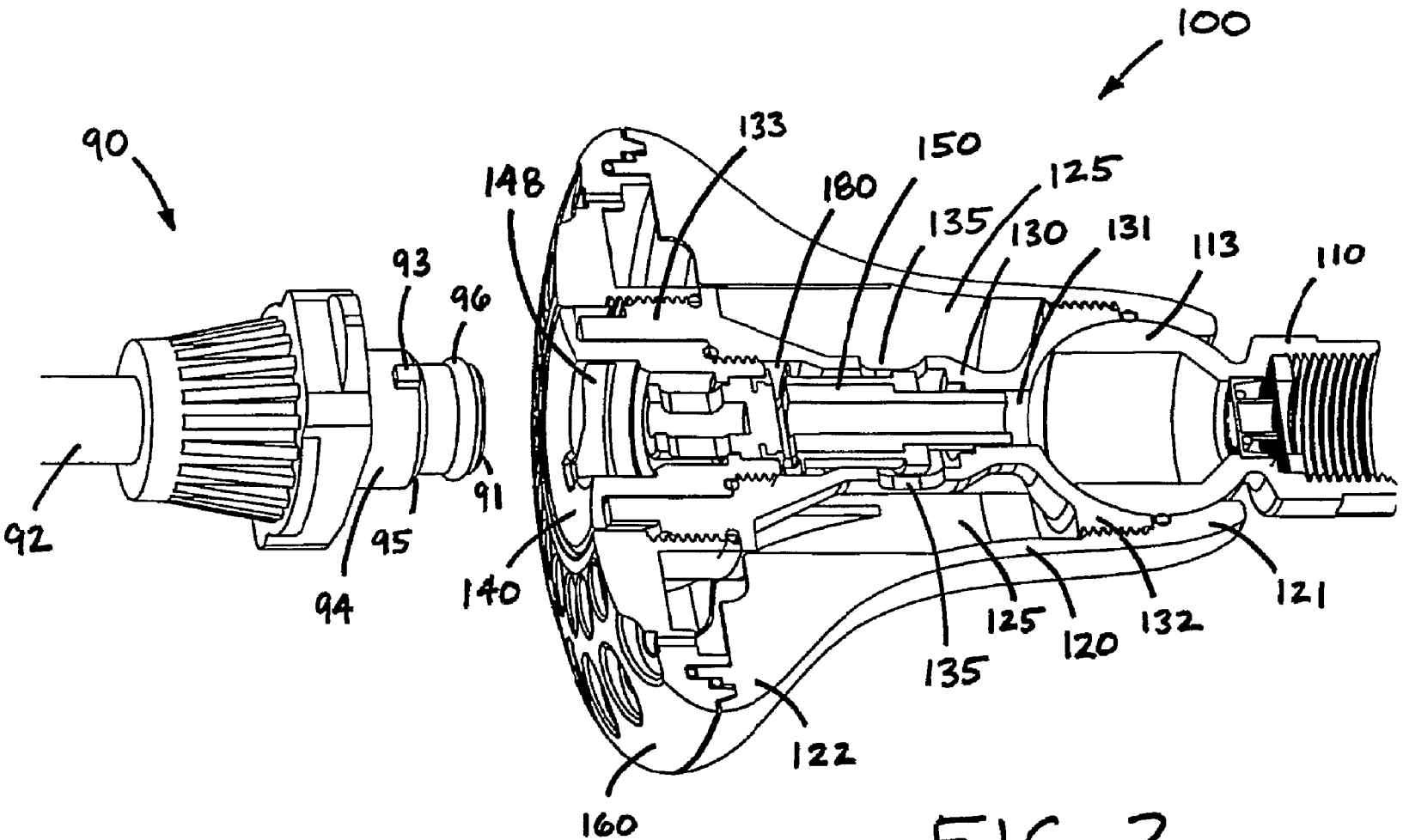
FIG. 2 is a view of the showerhead and valve assembly similar to that shown in FIG. 1 and showing an attachment and a valve runner in the valve "closed" position.
Figure 3:
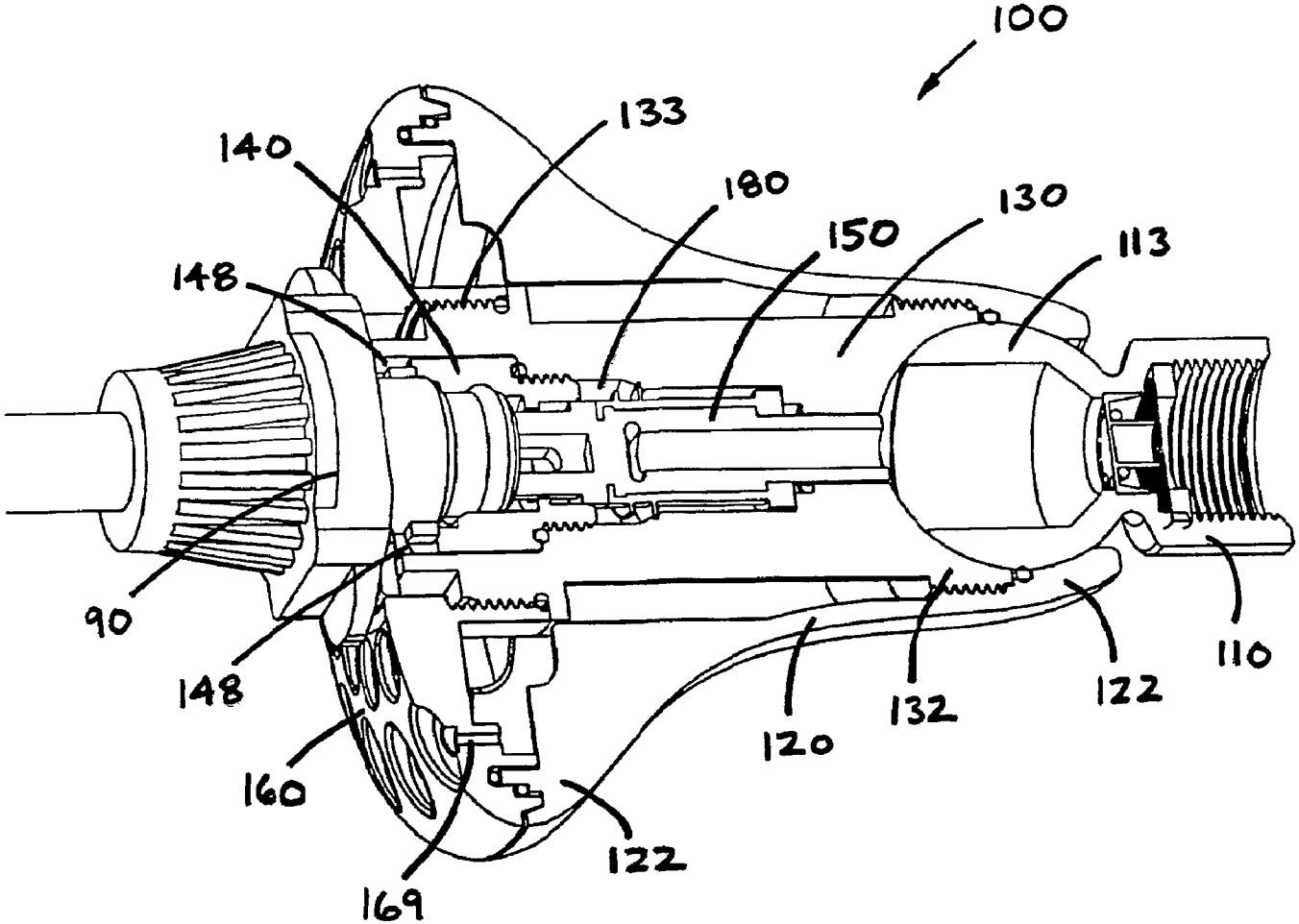
FIG. 3 illustrates the showerhead and valve assembly shown in FIG. 2 and showing the attachment secured to the showerhead and also showing the valve runner in the valve "open" position.

Referring now to the drawings in detail, wherein like numbers represent like elements throughout, FIG. 1 illustrates one embodiment of an improved showerhead, generally identified 100, constructed in accordance with the present invention. As shown, the showerhead 100 has an outer casing 120 that is attached to an inner casing 130. The outer casing 120 and the inner casing 130 define a flow chamber 125 between them. A valve runner 150 is slidingly positioned within a generally cylindrical cavity 180 that is defined by the inner casing 130. An attachment housing 140 is attached to the inner casing 130 to constrain the axial movement of the valve runner 150 within the cavity 180. The valve runner 150 is also constrained in its longitudinal movement within the cavity 180 between a first position and a second position. See FIGS. 2 and 3. In the first position, as shown in FIG. 2, the valve runner 150 allows for the diversion of water through the flow chamber 125. In the second position, as shown in FIG. 3, the valve runner 150 allows for the diversion of water through the attachment housing 140 and through an attachment 90.

It is to be understood that the individual components of showerhead 100, including the outer casing 120, the inner casing 130, the attachment housing 140, and the valve runner 150, as well as other elements yet to be described, may be fabricated out of any standard material, such as molded plastic or cast metal, without deviating from the scope of this invention.

Examining the showerhead 100 in greater detail, it will be seen that, in the preferred embodiment, the inner casing 130 is configured to define an axial bore 131 extending from a first end 132 to a second end 133 such that fluid may flow axially through the interior of inner casing 130. Further defined by the sides of the inner casing 130 is the aforementioned inner cavity 180 which is disposed between first and second ends 132, 133 such that the axial bore 131 is in fluid communication with the inner cavity 180. The medial portion 184 of the cavity 180 is provided with a plurality of apertures 135 to allow fluid communication between the inner cavity 180 and the flow chamber 125. The inner casing 130 may also be provided with an interior stop shoulder 136 against which a proximal, or upstream, portion 166 of the valve runner 150 may rest. Similarly, the attachment housing 140 may be provided with an interior stop shoulder 146 against which a distal, or downstream, portion 167 of the valve runner 150 may rest.

A face casing 160 is also provided. The face casing 160 has an external circumferential flange 168 which sealingly engages the outer casing 120 to further define the flow chamber 125. A plurality of apertures 169 are disposed within the face casing 160 to allow fluid communication between the flow chamber 125 and the exterior of the showerhead 100. It is to be understood that the face casing 160 could be integrally formed as part of the outer casing 120 or as part of the attachment housing 140 without deviating from the scope of the present invention.

The outer casing 120 has a first end 121 with a first diameter and a second end 122 with a second diameter, the second diameter being larger than the first diameter. A water inlet 110 in fluid communication with the axial bore 131 seats in the first end 121 of the outer casing 120. In the preferred embodiment, the water inlet 110 has a spherical shape at one end to allow a ball-and-socket attachment with the outer casing 120. A socket 113 and o-ring 114 seat within the first end 121 of outer casing 120 and within the first end 132 of the inner casing 130 to permit ball-and-socket attachment of the water inlet 110. This type of ball-and-socket attachment will allow the showerhead 100 to be universally swiveled relative to a standard water supply pipe (not shown).

Figure 4:
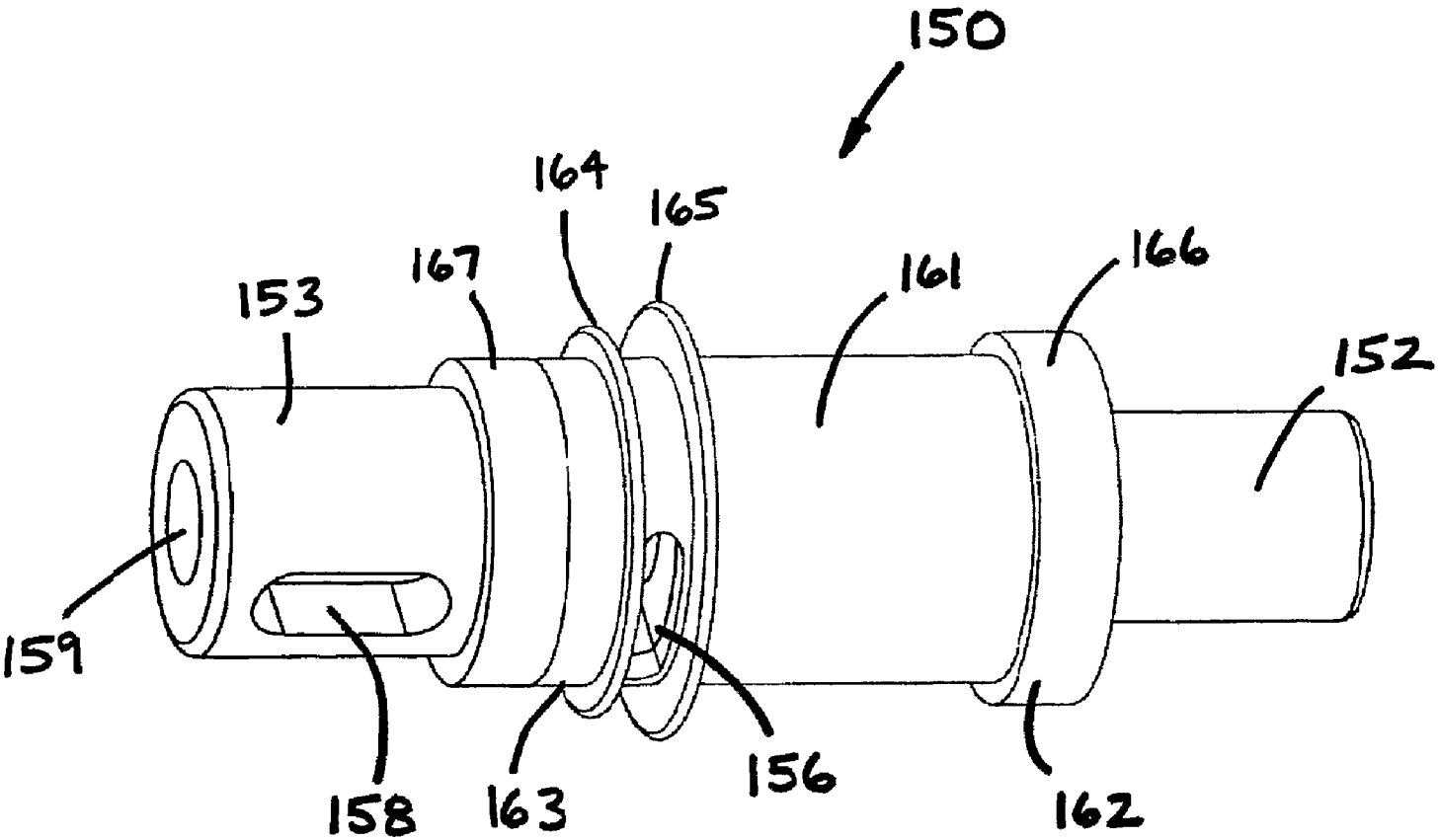
FIG. 4 is an enlarged front, side and bottom perspective view of the valve runner configured in accordance with the present invention.
Figure 5:
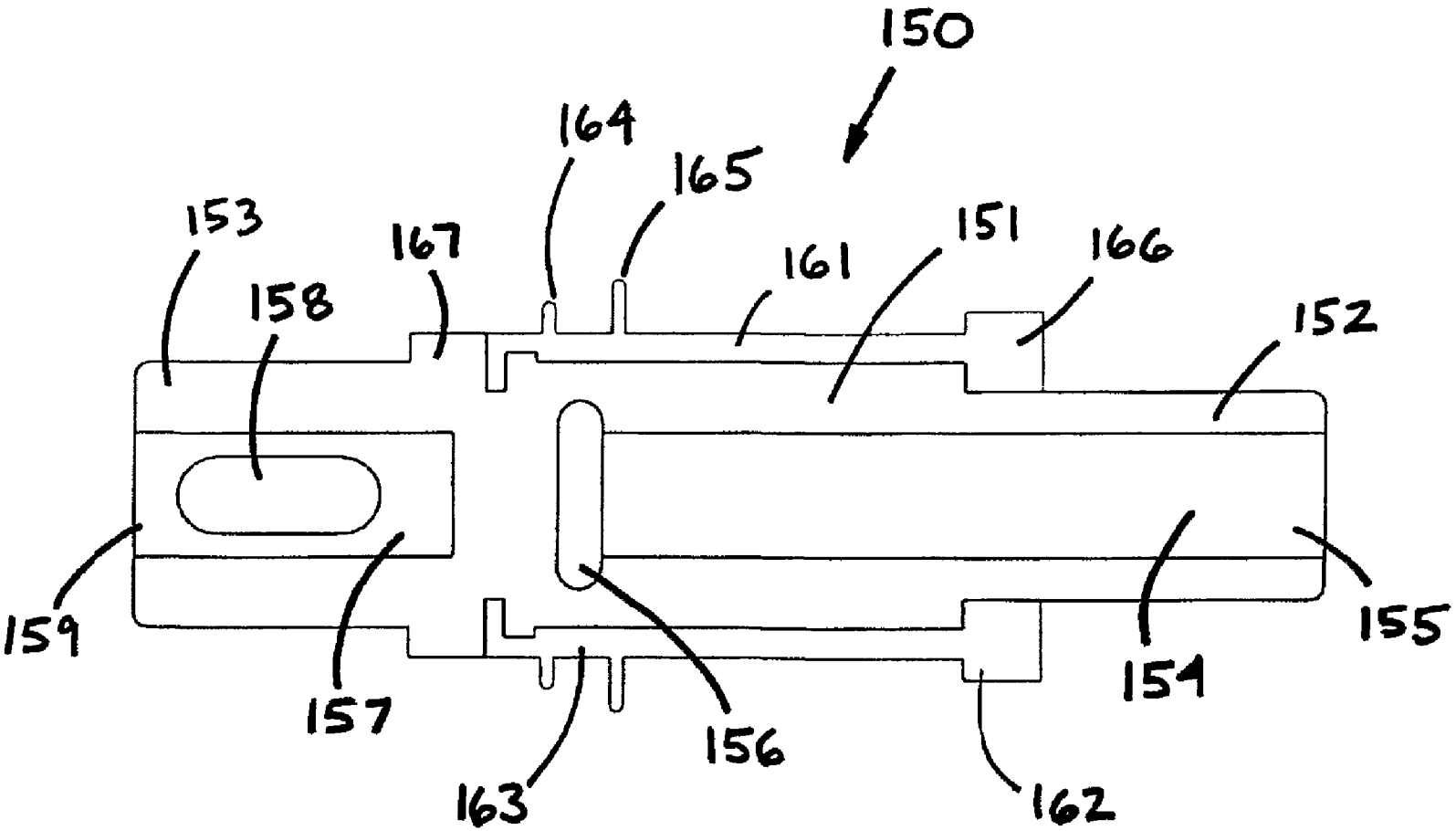
FIG. 5 is a cross sectional side view of the valve runner.

Referring now to FIGS. 4 and 5, it will be seen that the improved valve runner 150 of the present invention is comprised of a tubular shaped central plug 151 having a first end 152 and a second end 153. The valve runner 150 is provided with a first interior passage 154 having an inlet 155 and an outlet 156. The inlet 155 is aligned along the axis of the plug 151 and extends from the first end 152. The outlet 156, which extends radially from the axis of the plug 151, has a slot shape and is in fluid communication with the exterior surface of the plug 151.

The valve runner 150 of the preferred embodiment is also provided with a second interior passage 157 having an inlet 158 and an outlet 159. The outlet 159 is aligned along the axis of the plug 151 and extends from the second end 153 of the of the plug 151. The inlet 158 extends radially from the axis of the plug 151 and has a slot shape which is in fluid communication with the exterior surface of the plug 151. The second end 153 of the plug 151 also includes a circumferentially extending shoulder 167.

Formed as either a part of the plug 151, or being attachable to it, is a surrounding plug sleeve 161. While, in the preferred embodiment, the plug 151 is formed of a rigid plastic material, the sleeve 161 is formed of a more resilient, rubber-like material. The sleeve 161 has a first end 162 and a second end 163. Located at the first end 162 of the sleeve 161 is a sleeve shoulder 166. Situated at the second end 163 of the sleeve 161 is a first flange 164 and a second flange 165.

The first flange 164 is disposed circumferentially on the surface of the plug 151 above the outlet 156 of the interior passage 154 and the second flange 165 is disposed circumferentially on the surface of a plug 151 below the outlet 156 of the interior passage 154. The first flange 164 has a first diameter and the second flange 165 has a second diameter, the second diameter being greater than the first diameter.

The attachment housing 140 is defined by a first end 141, a second end 143, a through bore 144 and an internal shoulder 146. In the preferred embodiment, the inner diameter of first end 141 is roughly equivalent to the diameter of the distal portion 186 of the annular cavity 180. The second end 133 is configured to receive the attachment 90 which includes a coupling 91 attached to flexible conduit 92. Although coupling 91 may take many forms, the preferred embodiment comprises an adapter 95, a locking ring 94 and an o-ring 96. Locking ring 94 is secured to adapter 95 by flexible conduit 92 such that when coupling 91 seats in sealing contact within the second end 143, the flexible conduit 92 is in fluid communication with the attachment housing 140. O-ring 96 enhances sealing contact between the coupling 91 and the attachment housing 140. In the preferred embodiment, the attachment housing 140 is provided with diametrically opposed hook shaped recesses 148 for receiving opposing tabs 93 disposed on the exterior surface of the locking ring 94. See FIG. 3. The attachment housing 140, when incorporated with showerhead 100, attaches to the inner casing 130 at its second end 133 of the bore 131 to further define the inner cavity 180 and constrain the valve runner 150 within the cavity 180.

The operation of the showerhead 100 and its valve assembly will now be described. When the valve runner 150 is in the first position as shown in FIG. 2, there is no attachment 90 coupled to showerhead 100. In this position, the distal end of the 153 of the valve runner 150 extends as far downstream within the cavity 180 as it can and the shoulder 167 is seated against the stop shoulder 146 of the attachment housing 140. In this fashion, water entering the showerhead 100 by means of the water inlet 110 flows through the proximal portion 182 of the cavity 180 and through the first interior passage 154 of the valve runner 150. The water flows through the valve runner outlet 156, over the second flange 165 of the plug sleeve 161, through the distal portion 186 of the cavity 180 and into the medial portion 184 of the cavity 180. The water then flows through the apertures 135 defined within the inner casing 130. The apertures 135 allow fluid communication between the inner cavity 180 and the flow chamber 125 of the showerhead 100. Water then passes through the apertures 169 defined within the face casing 160. In the preferred embodiment, it is intended that the coefficient of friction between the valve runner 150 and all parts adjacent to it be very low. In this fashion, the valve runner 150 moves to the position shown in FIG. 2 simply by gravity being exerted on it. That is, the valve runner 150 essentially "floats" within the cavity 180. While water flowing through the proximal portion 182 of the cavity 180 exerts some downward force on the proximal end 152 of the valve runner 150, this is not intended to be the primary way that the valve runner 150 ends up in this "closed" position.

When the attachment 90 is coupled to the showerhead 100 as shown in FIG. 3, the attachment urges the runner valve 150 to move opposite the direction of the force provided by gravity or fluid flow. This is the second, or "open", position for the valve runner 150. In this second position, the valve runner 150 seats within the cavity 180 of the inner casing 130 such that sealing contact is provided between the valve runner 150 and the internal housing 130 by means of the second flange 165. Thus, water flowing out of the first interior passage 154 by means of the outlet 156 travels over the first flange 164 at the distal portion 186 of the cavity 180, through the second interior passage 157 of the valve runner 150 by means of the inlet 158 and outlet 159, through the bore 144 of the attachment housing 140, and through the adapter 95 and into the flexible conduit 92. Upon disconnection of the attachment 90, gravity will cause the valve runner 150 to return to its position as shown in FIG. 2.

Although the invention has been described in considerable detail through the figures and above discussion, it is to be understood that many variations and modifications can be made by one skilled in the art without departing from the spirit and scope of the invention as described in the following claims.

The invention claimed is:

1. An improved showerhead and rinsing system comprising:

a hollow outer casing having a first end and a second end;

an inner casing mounted within said outer casing such that a flow cavity is defined therebetween, said inner casing defined by a first end, a second end and an inner cavity disposed between the first end of the inner casing and the second end of the inner casing, said first end of the inner casing having at least one aperture for fluid communication between said flow cavity and said inner cavity, an upstream interior stop shoulder and a downstream interior stop shoulder;

a valve runner slidingly contained within the inner cavity of said inner casing, said valve runner defined by a first end, a second end, a first bore extending axially inwardly from the first end, a second bore extending axially inwardly from the second end, and, a shoulder towards the second end of the valve runner, the shoulder limiting downstream travel of the valve runner when it contacts the downstream stop shoulder of the inner casing;

a flexible conduit;

a valve runner sleeve covering a portion of the valve runner, the valve runner sleeve comprising a shoulder, the shoulder limiting upstream travel of the valve runner when it contacts the upstream stop shoulder of the inner casing, a first flange and a second flange;

means for receiving the flexible conduit; and fluid inlet means adjacent the first end of said outer casing, said fluid inlet means in fluid communication with the first bore of said valve runner for supplying fluid to the first bore;

wherein said valve runner is operable to slide downstream when influenced by fluid pressure, gravity or a combination of fluid pressure and gravity within the inner cavity to a first position in which the shoulder towards the second end of the valve runner contacts the downstream stop shoulder of the inner casing such that fluid flow is directed from the fluid inlet means, through the at least one aperture in the first end of said inner casing by the first flange, which prevents the flow of water to the second bore and into the flow cavity, to a second position in which the valve runner is pushed upstream by attachment of the flexible conduit to the showerhead such that the shoulder of the valve runner sleeve is in contact with the upstream interior stop shoulder in the inner casing and the second flange prevents the flow of fluid into the inner casing such that fluid flow is directed from the fluid inlet means through said first and second bores of the valve runner and to the flexible conduit.

2. The improved showerhead and rinsing system of claim 1 wherein the means for receiving the flexible conduit comprises an attachment housing engaged with the second end of said inner casing said attachment housing having an axial bore therethrough.

3. The improved showerhead and rinsing system of claim 2 wherein said inner casing further includes a circumferential flange extending outward from the second end of said inner casing, the circumferential flange having apertures therethrough, wherein said flange attaches to the second end of said outer casing.

4. The improved showerhead and rinsing system of claim 3 wherein said valve runner is urged to the second position when the flexible conduit is attached to the attachment housing.

5. The improved showerhead and rinsing system of claim 1 wherein the first valve runner sleeve flange has a first diameter and the second valve runner sleeve flange has a second diameter, the second diameter being greater than the first diameter.

6. The improved showerhead and rinsing system of claim 1 wherein the valve runner sleeve is comprised of a resilient material.

7. An improved showerhead for receiving a conduit attachment, said showerhead comprising:

a hollow outer casing having a first end and a second end;

an inner casing mounted within said outer casing such that a flow cavity is defined therebetween, said inner casing defined by a first end, a second end and an inner cavity disposed between the first end of the inner casing and the second end of the inner casing, said first end of the inner casing having at least one aperture for fluid communication between said flow cavity and said inner cavity, an upstream interior stop shoulder and a downstream interior stop shoulder;

a valve runner slidingly contained within the inner cavity of said inner casing, said valve runner comprising a first end and a second end, a first bore extending axially inwardly from the first end and a first bore outlet, a second bore extending axially inwardly from the second end and a second bore inlet, and a shoulder towards the second end of the valve runner, the shoulder limiting downstream travel of the valve runner by contacting the downstream stop shoulder of the inner casing;

a valve runner sleeve covering a portion of the valve runner, the valve runner sleeve comprising a shoulder, the shoulder limiting upstream travel of the valve runner by contacting the upstream stop shoulder of the inner casing, a first valve runner flange and a second valve runner flange;

means for receiving the conduit attachment, and fluid inlet means adjacent the first end of said outer casing, said fluid inlet means in fluid communication with the first bore of said valve runner for supplying fluid to the first bore, wherein said valve runner is operable to slide downstream when influenced by fluid pressure, gravity or a combination of fluid pressure and gravity within the inner cavity to a first position in which the shoulder towards the second end of the valve runner contacts the downstream stop shoulder of the inner casing such that fluid flow is directed from the fluid inlet means into the first bore and then out of the first bore through the first bore outlet, through the at least one aperture in the first end of said inner casing by the first flange, which prevents the flow of water to the second bore and into the flow cavity, to a second position in which the valve runner is pushed upstream by attachment of the conduit attachment such that the shoulder of the valve runner sleeve is in contact with the upstream interior stop shoulder in the inner casing and the second flange prevents the flow of fluid into the inner casing such that fluid flow is directed from the first bore outlet to the second bore inlet, through the second bore of the valve runner and into the conduit attachment.

8. The improved showerhead of claim 7 wherein the first valve runner flange has a first diameter and the second valve runner flange has a second diameter, the second diameter being greater than the first diameter.

9. The improved showerhead of claim 7 wherein the valve runner sleeve is comprised of a resilient material.

* * * * *